US007748320B2

(12) United States Patent
Ikeda

(10) Patent No.: US 7,748,320 B2
(45) Date of Patent: Jul. 6, 2010

(54) SHEET FEEDING DEVICE AND IMAGE FORMING APPARATUS

(75) Inventor: Taro Ikeda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 228 days.

(21) Appl. No.: 11/455,651

(22) Filed: Jun. 20, 2006

(65) Prior Publication Data

US 2006/0288893 A1 Dec. 28, 2006

(30) Foreign Application Priority Data

Jun. 28, 2005 (JP) ..... 2005-188802

(51) Int. Cl.
*B65H 3/14* (2006.01)
*B41L 5/16* (2006.01)
*B41L 15/14* (2006.01)
*B41L 49/00* (2006.01)

(52) U.S. Cl. ..... 101/480; 271/97

(58) Field of Classification Search ..... 101/480; 271/13, 14, 145, 162, 141, 4.01, 5, 97, 98
See application file for complete search history.

(56) References Cited

U.S. PATENT DOCUMENTS 5,215,303 A * 6/1993 Yamada et al. ..... 271/240
5,645,274 A * 7/1997 Ubayashi et al. ..... 271/94
5,746,571 A * 5/1998 Dietschi et al. ..... 414/795.7
6,082,728 A * 7/2000 Ubayashi ..... 271/108
6,688,592 B1 * 2/2004 Tan et al. ..... 271/171
6,883,799 B2 * 4/2005 Matsuki et al. ..... 271/171
6,955,348 B2 * 10/2005 Koga ..... 271/97
2004/0089994 A1 * 5/2004 Koga et al. ..... 271/98
2006/0017209 A1 1/2006 Kushida et al. ..... 270/37
2006/0017218 A1 1/2006 Kawata et al. ..... 271/207
2006/0019811 A1 1/2006 Ikeda et al. ..... 493/444

FOREIGN PATENT DOCUMENTS

JP 9-309624 12/1997

* cited by examiner

*Primary Examiner*—Judy Nguyen
*Assistant Examiner*—Leo T Hinze
(74) *Attorney, Agent, or Firm*—Fitzpatrick, Cella, Harper & Scinto

(57) ABSTRACT

A sheet feeding device which feeds a sheet by loosening a sheet by loosening sheets by blowing air to the end portions of the sheets, comprising: a sheet tray provided to be capable of lifting up/down supporting the sheets; air blowing means which loosens the sheets by blowing air to the end portion at the topside of the sheets supported by the sheet tray; and a pair of restricting members which restricts both end portions in the direction perpendicular to the sheet feeding direction of the sheet with sheet opposing faces opposing the end portions of the sheets, wherein the interval between the sheet opposing faces at the top side of the pair of the restricting members is set larger than the interval between the sheet opposing faces below the position in which air is blown to the sheets with the air blowing means.

6 Claims, 13 Drawing Sheets

SHEET FEEDING DEVICE AND IMAGE FORMING APPARATUS

BACKGROUND OF THE INVENTION

1. Field of the Invention

The present invention relates to a sheet feeding device for feeding a sheet by loosening sheets by blowing air to a sheet stack and an image forming apparatus including the sheet feeding device.

2. Description of the Related Art

As one of methods for feeding sheets one by one from sheet storage means (hereinafter referred to as storage compartment) in an image forming apparatus such a printer, a copying machine, conventionally, an air sheet feeding device has been proposed. According to this method, as disclosed in Japanese Patent Application Laid-Open NO. 9-309624, gas (mainly, air) is blown to an end portion of a sheet stack to lift up plural sheets and separate them from each other and the sheet is carried while sucked with a conveyance belt.

An example of the conventional air sheet feeding device will be described with reference to FIGS. 12, 13. FIG. 12 is a schematic sectional explanatory diagram of the conventional air sheet feeding device and FIG. 13 is a sectional view taken along N-N in FIG. 10.

A storage compartment 201 includes a sheet tray 202 which is capable of lifting up/down. A sheet stack S is placed on this sheet tray 202 and side restricting plates 203*a*, 203*b* are struck against both end portions in the width direction (direction perpendicular to the sheet feeding direction) of the sheets. Further, a rear end restricting plate 204 is struck against the rear end of the sheets. Consequently, the sheet stack S placed on the sheet tray 202 is positioned.

Upon feeding the sheets, the sheet tray 202 is raised by driving means (not shown) and stopped at a position in which the topside of the sheet stack S is off a suction belt 205 by a predetermined distance. Then, when a separation fan 206 is actuated to blow air to the side face at the topside of the sheet stack, several pieces at the topside of the sheet stack are loosened. With this condition, a suction fan 207 is actuated to suck the sheet at the topmost to the suction belt 205 and that belt 205 is rotated to feed a single sheet.

When for example, 2000 pieces of sheets having a weight of 80 g/m$^2$ are accommodated in the above-described air sheet feeding device, the height thereof before floated, that is, C in FIG. 13 is about 220 mm. It is very difficult for user to set these accurately without any deviation in the sheet width direction. Thus, there has been proposed a device adopting the structure which allows right and left side restricting plates 203*a*, 203*b* to move interlockingly in the restricting direction with respect to the center of the sheet setting position so as to restrict the position of the sheets securely.

In such a device, first, the positions of the side restricting plates 203*a*, 203*b* are adjusted corresponding to the size of a small amount of sheets taking care so that there is no gap between the sheet stack S and the side restricting plates. If remaining sheets S are set with this condition, no deviation in the sheet width direction occurs.

However if the sheets are set so strictly that there is no gap between the sheet stack S and the side restricting plates, a large friction resistance is generated between the surfaces of the side restricting plates 203*a*, 203*b* and the sheet end portion in a portion D of FIG. 13. As a result, when air is blown against a sheet, it might not be floated sufficiently enough to be fed. Further, if the dispersion of the size of each sheet is large or the dispersion of the dimension of the side restricting plates 203*a*, 203*b* or other component is large, tendency of sheet feeding failure becomes more conceivable.

The air sheet feeding device is a system susceptible to an influence of friction resistance at the portion D in FIG. 13 described above. If the quantity of blown air is increased to eliminate this tendency, the size of the air supply means is enlarged or the quantity thereof is increased, thereby leading to enlargement of the size of the entire apparatus or increase of manufacturing cost of the product.

SUMMARY OF THE INVENTION

The present invention has been achieved to solve the above described problem and an object of the invention is to provide a sheet feeding device capable of suppressing the deviation of sheet position in the direction perpendicular to a sheet feeding direction and an image forming apparatus including this sheet feeding device and capable of achieving high positional accuracy and high reliability.

To solve the above-described problem, the present invention provides a sheet feeding device which feeding a sheet by loosening sheets by blowing air to the end portions of the sheets, including:

a sheet tray provided to be capable of being lifted up/down supporting the sheets;

air blowing means which loosens the sheets by blowing air to a topside at an end portion of the sheets supported by the sheet tray;

and a pair of restricting members which restricts both end portions in the direction perpendicular to the sheet feeding direction of the sheet with sheet opposing faces opposing the end portions of the sheets, wherein the interval between the sheet opposing faces at the topside of the pair of the restricting members is set larger than the interval between the sheet opposing faces below the position in which air is blown to the sheets with the air blowing means.

DESCRIPTION OF THE PREFERRED EMBODIMENTS

Hereinafter, the image forming apparatus including the sheet feeding device according to an embodiment of the present invention will be described with reference to the accompanying drawings.

First Embodiment

Figure 1:
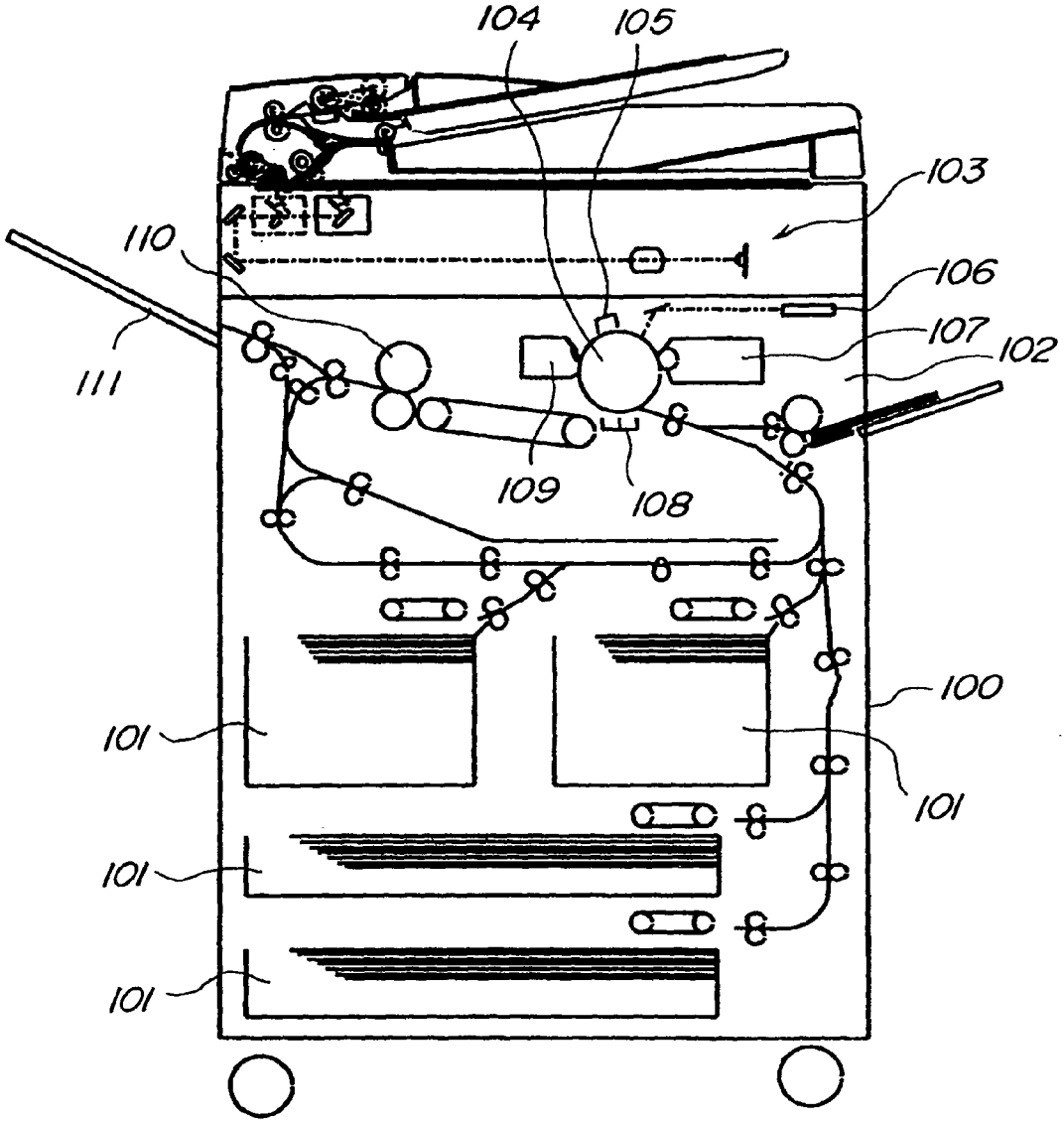
FIG. 1 is an entire schematic sectional explanatory diagram of an image forming apparatus.
Figure 4:
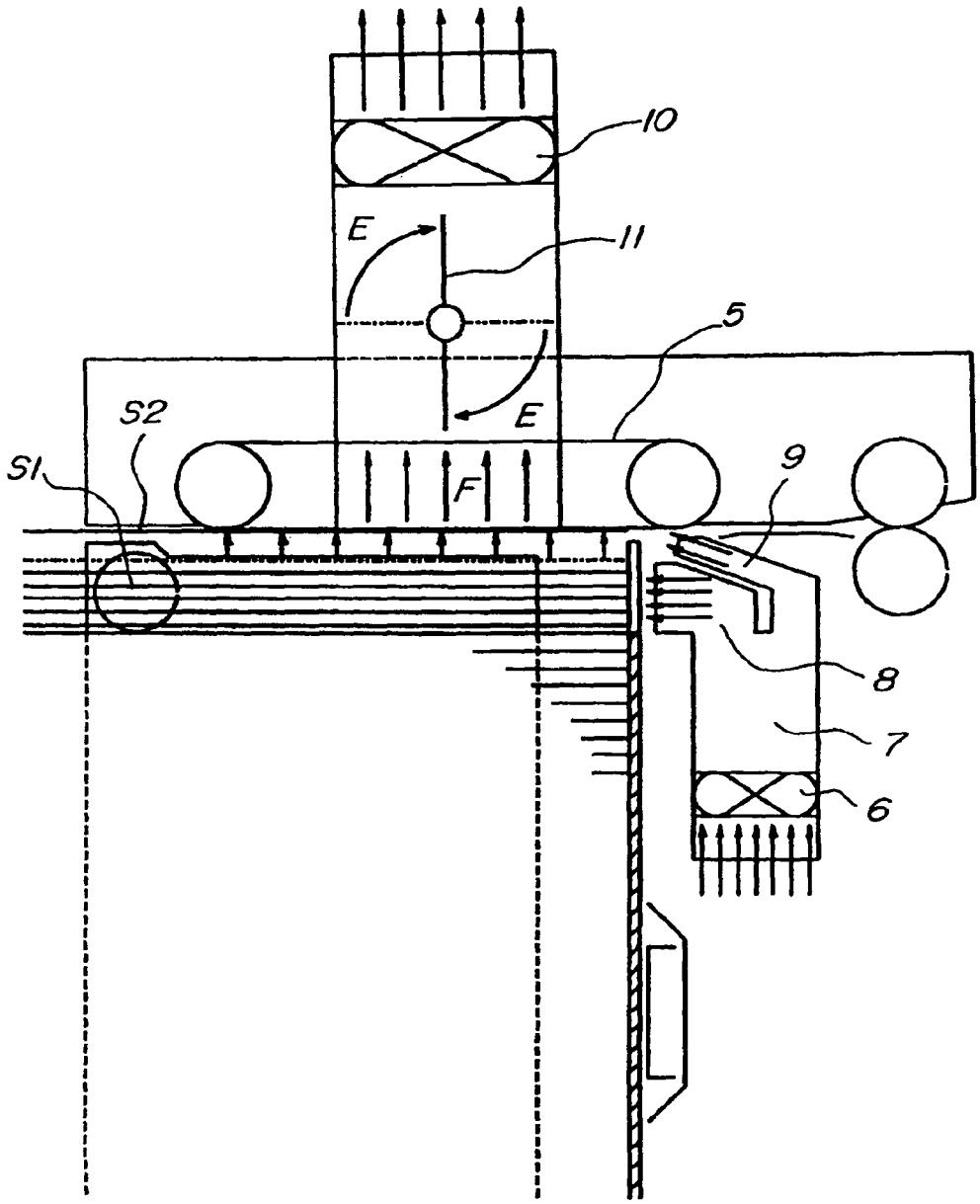
FIG. 4 is an explanatory diagram for explaining a state separating sheets with the sheet feeding device.
Figure 5:
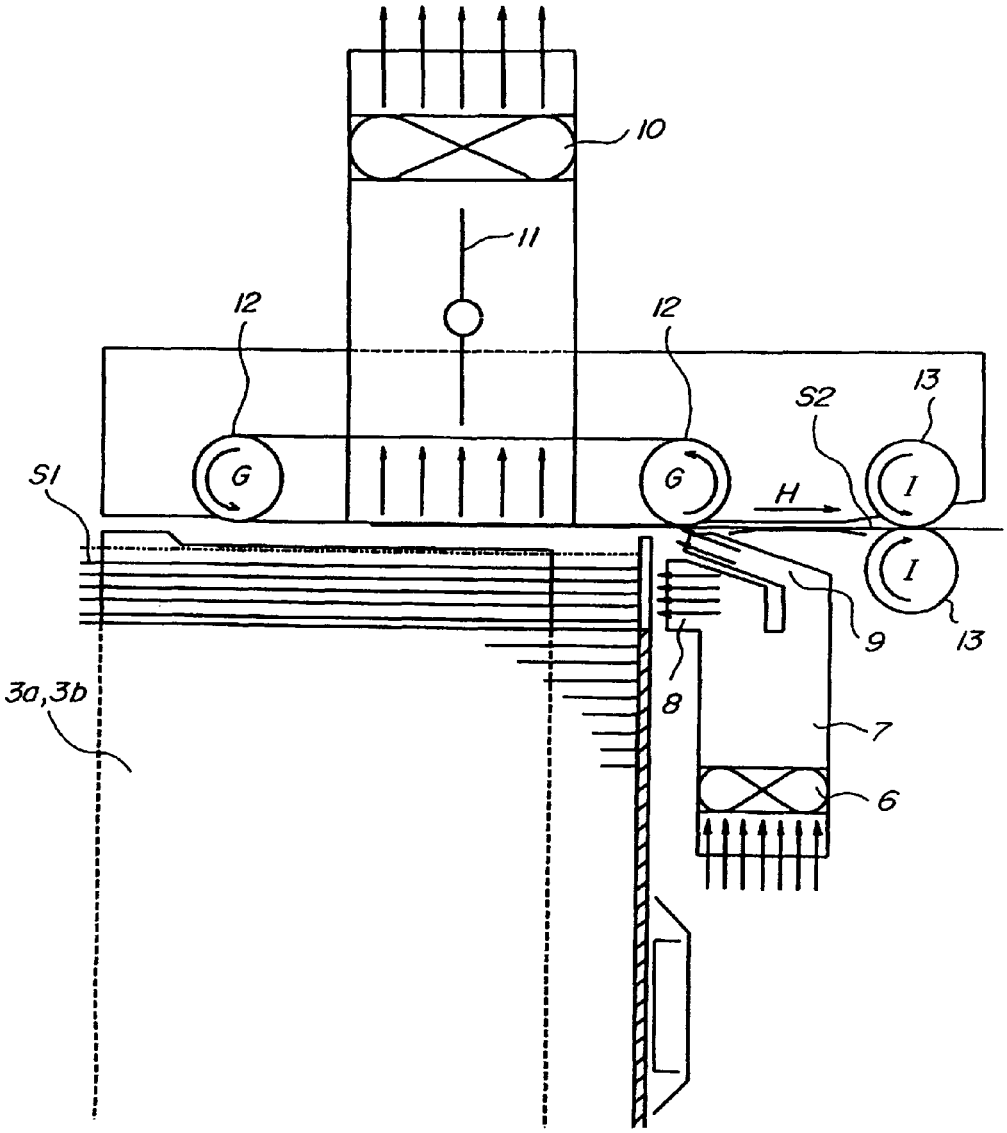
FIG. 5 is an explanatory diagram for explaining a state feeding separated sheets with the sheet feeding device.
Figure 6:
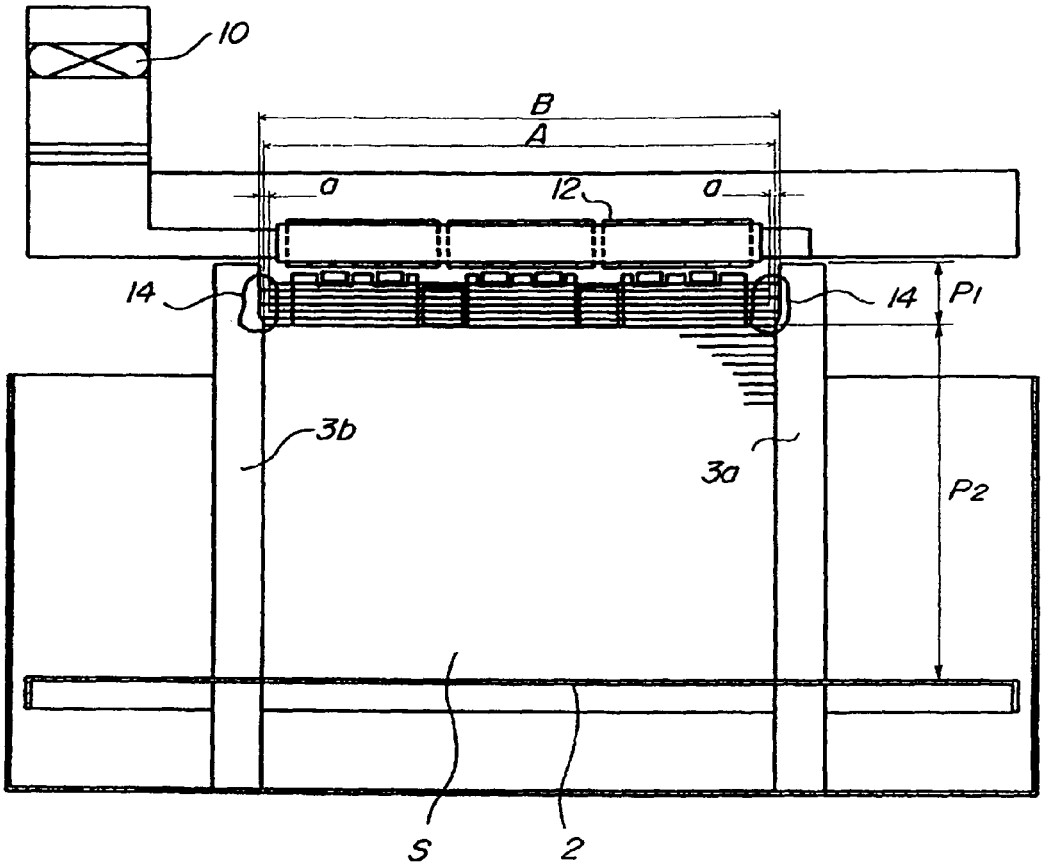
FIG. 6 is an explanatory diagram of a side restricting plate having a difference in step.
Figure 7:
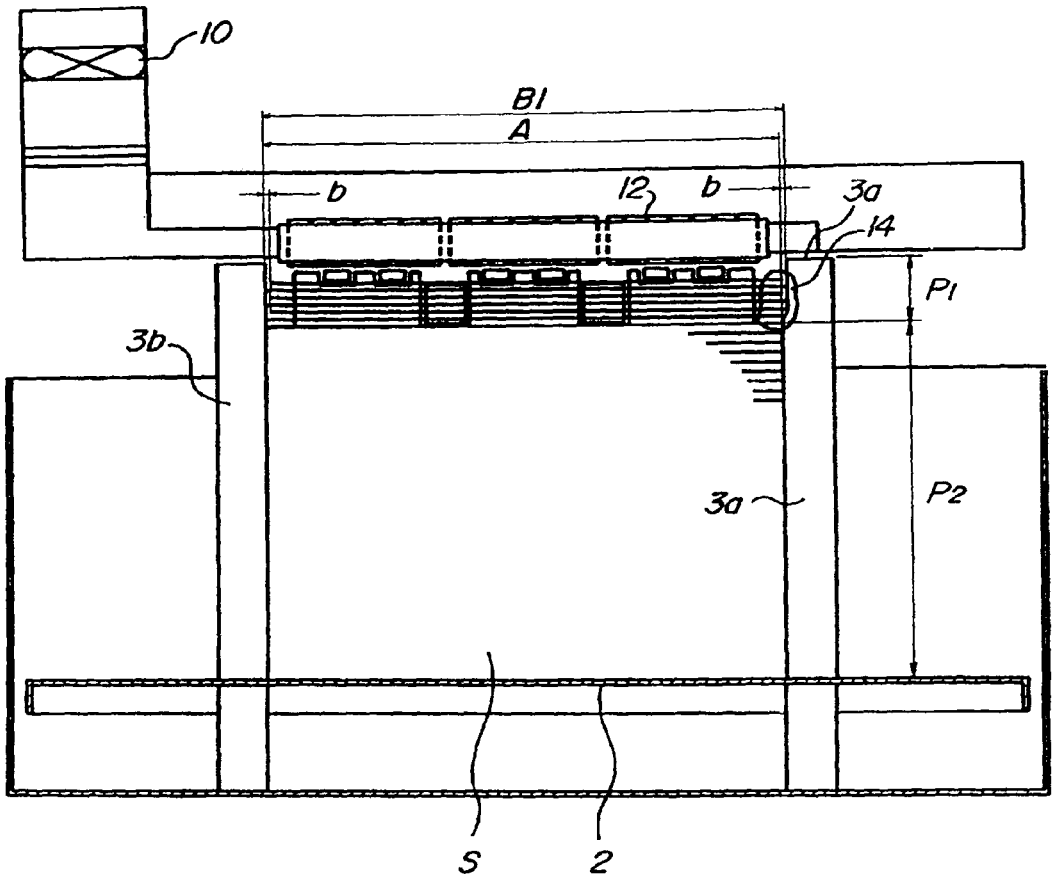
FIG. 7 is an explanatory diagram of a sheet feeding device having a difference in step at the side restricting plate on only one side.

FIGS. 1-7 show the first embodiment. FIG. 1 is an entire schematic sectional explanatory diagram of the image forming apparatus. FIGS. 2-5 are explanatory diagrams of the air sheet feeding device. FIGS. 6, 7 are explanatory diagrams showing the characteristic portion of the air sheet feeding device.

[Image Forming Apparatus]

First, the entire structure of the image forming apparatus will be described. In the image forming apparatus of this embodiment, a sheet feeding device 101 is disposed at the bottom of the apparatus main body 100 and an image formation device 102 is disposed above it. Then, an image reading device 103 which reads an original optically and converts to electric signals is disposed at the topmost of the apparatus main body 100.

The sheet feeding device 101 is an air sheet feeding device, whose structure will be described in detail below. A sheet S fed from this sheet feeding device 101 is conveyed to the image formation device 102 by a conveying roller pair.

The image formation device 102 of this embodiment is of electrophotographic type, in which a charger 105, exposing means 106, a development device 107, a transfer charging device 108 and a cleaning device 109 are disposed around a photosensitive drum 104. Upon formation of an image, after the surface of the rotating photosensitive drum 104 is charged uniformly with the charging device 108, an electrostatic latent image is formed by exposure corresponding to an image signal from the exposing means 106. This latent image is developed into a visible image by the development device 107 and that toner image is transferred to a conveyed sheet by application of bias to the transfer charging device 108. After the toner image is transferred, the sheet is conveyed to a fixing device 110 in which the toner image is fixed, and discharged to a discharging portion 111. On the other hand, remaining toner on the photosensitive drum 104 after the toner image is transferred is removed by the cleaning device 109.

[Sheet Feeding Device]

Next, the sheet feeding device 101 for feeding the sheet to the image formation device 102 will be described. According to this embodiment, four sheet feeding devices 101 are provided at the bottom of the apparatus main body as shown in FIG. 1 and the sheet is fed from the sheet feeding device 101 which accommodates sheets of a selected size.

Figure 2:
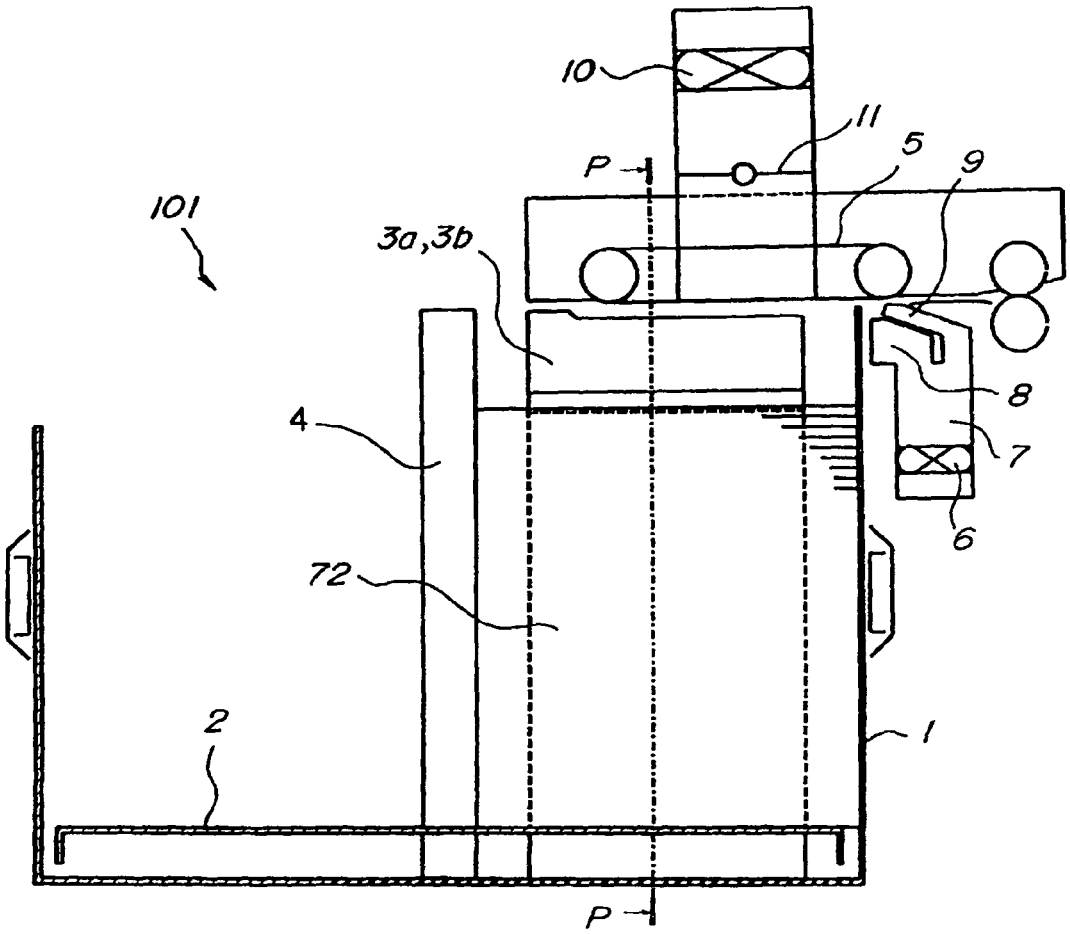
FIG. 2 is an explanatory diagram of the sheet feeding device.

In the sheet feeding device 101, as shown in FIG. 2, a sheet tray 2 is provided in its storage compartment 1 so that it is capable of lifting up/down. Side restricting plates 3*a*, 3*b*, which are a pair of restricting members for restricting the sheet width direction by striking their sheet opposing faces against their sheet end portions, are provided on both sides in the width direction (direction perpendicular to the sheet feeding direction) of a sheet stack S placed on this sheet tray 2. The right and left side restricting plates 3*a*, 3*b* in pair can be moved symmetrically with respect to the sheet width direction by slide rails (not shown) so as to restrict the position in the width direction of the sheet stack S with its center as a criterion.

Further, a rear end restricting plate 4 for restricting the rear end position by making contact with the rear end (end portion on the upstream side in the sheet feeding direction) of the sheets placed on the sheet tray 2 is provided slidably.

In the sheet feeding device 101, when the storage compartment is pulled out by a user, the sheet tray 2 stays at the bottommost. This state allows sheets to be replenished to the sheet tray 2. At this time, the topmost face of a sheet on the sheet tray 2 is not at the air blowing position described later. The position of the sheet tray 2 at this time is a replenishment position for replenishing sheets. Then, the positioning of the sheet stack S is executed by bringing the side restricting plates 3*a*, 3*b* and the rear end restricting plate 4 into a contact with the side ends of the sheet stack S.

A suction conveyance belt 5 is disposed above the storage compartment 1. A fan 10 and a duct are connected to this suction conveyance belt 5 and a sheet is sucked through suction holes (not shown) made in the suction conveyance belt 5 by the fan 5. A suction shutter 11 is disposed between the suction conveyance belt 5 and the fan 10 and suction/non-suction of the sheet is selected by opening/closing the suction shutter 11 with the fan 5 actuated.

When the storage compartment 1 is stored at a predetermined position after the sheet stack S is set on the sheet tray 2, the sheet tray 2 begins to be lifted up by driving means (not shown). Then, the top face of the sheet stack S stops at a position off by a predetermined distance from the suction conveyance belt 5 to stand by for a sheet feeding signal. At this time, the topside of the sheet stack set on the sheet tray 2 is located at an air blowing position to which air is blown from a separation fan 6 described later.

The separation fan 6 constitutes air blowing means for loosening the sheets by allowing them to float by blowing air to the side end of the topside of the sheet stack S located at the air blowing position. That is, when the sheet feeding device detects a feeding signal, the separation fan 6 is actuated so as to suck air in the direction of an arrow A in FIG. 3. This air is blown to the sheet stack in the directions of arrows B, C from a loosening nozzle 8 and a separation nozzle 9 through a separation duct 7. When air is blown from the loosening nozzle 8, several pieces S1 of the sheets located on the topside of the sheet stack S are loosened so that they float up as shown in FIG. 3.

Figure 3:
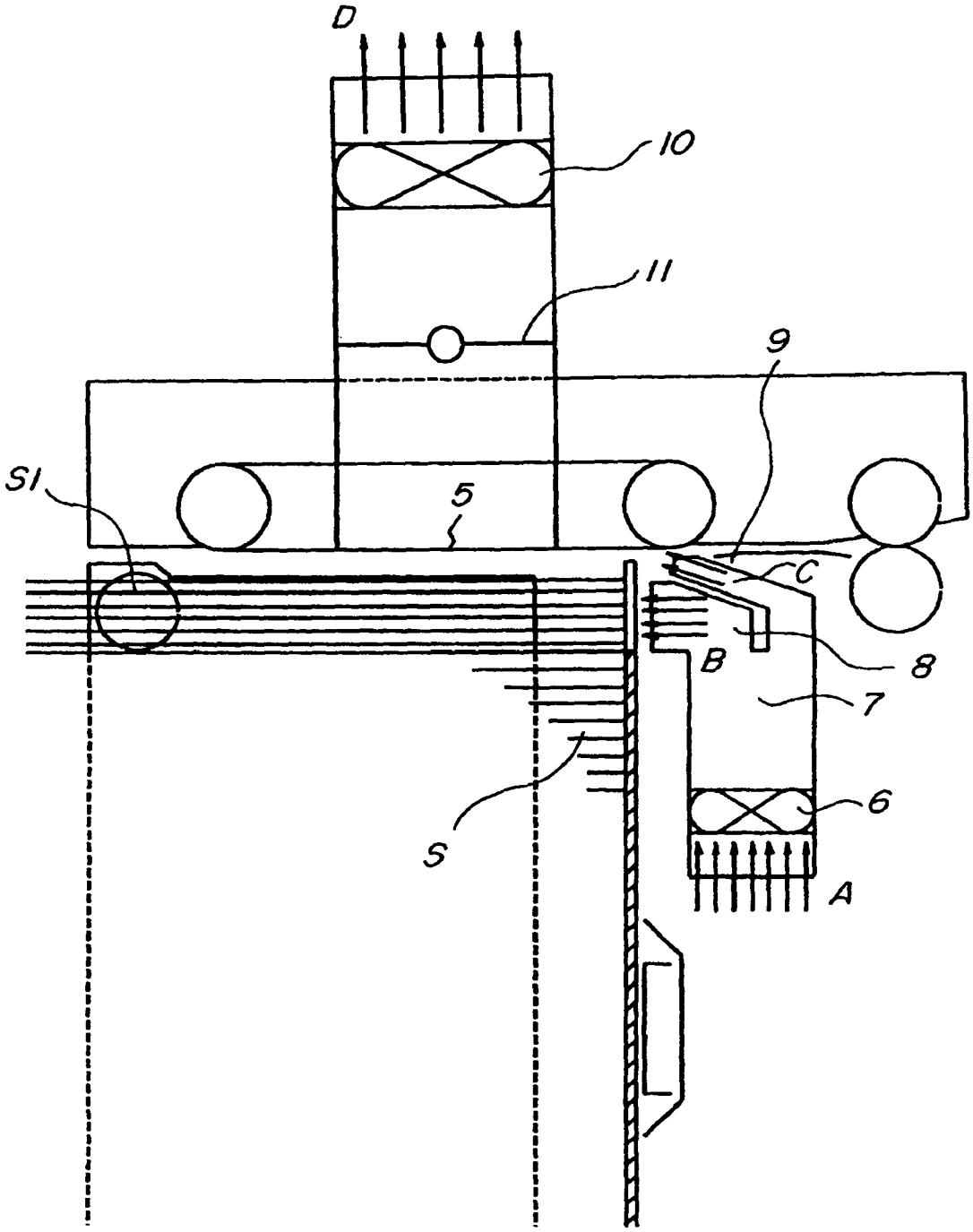
FIG. 3 is an explanatory diagram for explaining a state loosening of sheets with the sheet feeding device.

Then, the suction fan 10 is actuated to suck the sheets to the suction conveyance belt 5 so that air is discharged out in the direction of an arrow D in FIG. 3. At this time, the suction shutter 11 is still closed.

When the floating of the sheet S1 is stabilized after a predetermined time elapses since the feeding signal is detected, the suction shutter 11 is rotated in the direction of an arrow E in FIG. 4. Consequently, suction force is generated in the direction of an arrow F through a suction hole (not shown) made in the suction conveyance belt 5 and sheet S2 on the topmost is sucked. Other sheets than the one sucked directly to the suction conveyance belt 5 is separated from the suction conveyance belt 5 by keeping air blown through the separation nozzle 9.

When belt drive rollers 12 are rotated in the direction of an arrow G as shown in FIG. 5 with the above-described state, the sheet S2 is conveyed in the direction of an arrow H in FIG. 5 and when a pulling roller pair 13 are rotated in the direction of an arrow I in the same Figure, it is sent to a next conveyance path.

FIG. 6 is a schematic sectional explanatory diagram taken along P-P in FIG. 2. As shown in FIG. 6, the side restricting plates 3*a*, 3*b* of this embodiment have a step portion 14 on their sides making contact with the sheets. This step portion 14 is provided at the topside of the side restricting plates 3*a*, 3*b*, namely, in a portion at the air blowing position P1 in which the topside of the sheet stack is blown with air by the separation fan 6.

Here, as shown in FIG. 6, other portions than the air blowing positions of the side restricting plates 3*a*, 3*b* are assumed to be sheet replenishment position P2 in which the sheets are located when the sheet stack S is replenished to the sheet tray 2. An interval between the sheet opposing faces opposing the end portions of the sheet at the right and left side restricting plates 3*a*, 3*b* in pair is assumed to be A. On the other hand, an interval between the sheet opposing faces of the side restricting plates 3*a*, 3*b* at the step portion 14 provided at the air blowing position is assumed to be B. Then, according to this embodiment, the interval B is set to be slightly larger than the interval A (A<B). Further, when the interval A corresponds to the width of the sheet and the sheet stack is sandwiched by the right and left side restricting plates 3*a*, 3*b* corresponding to the width of the sheet, the position as feeding criterion in the width direction of the sheet is set up. The interval B of the topside of the right and left side restricting plates 3*a*, 3*b* is set larger than the interval A of the lower portion.

Consequently, the sheet stack S is positioned by bringing the side restricting plates 3*a*, 3*b* into contact with the sheet stack S placed on the sheet tray 2 at the replenishment position P2. Then, if the topside of the sheet stack S is moved up to the air blowing position P1 by raising the sheet tray 2, a gap a (B-A) is generated between the end portion of the sheet stack S and the side restricting plates 3*a*, 3*b*. Thus, when the sheet stack S is loosened by the separation fan 6, no friction resistance is generated between the end portion of the sheet stack S and the side restricting plates 3*a*, 3*b*, whereby obtaining an excellent floating condition.

The gap a (B-A) may be of any gap as long as the sheet can be floated without any trouble when the sheet located at the air blowing position is blown with air from the separation fan 6 and is preferred to be in such an extent that the deviation of the sheet in the width direction at the air blowing position is not increased.

According to this embodiment, both the side restricting plates 3*a*, 3*b* are provided with the step portions 14 which are provided symmetrically in order to set the gap a. This is because manufacturing cost is decreased by forming the right and left side restricting plates 3*a*, 3*b* with common components.

However, it is permissible to provide only one side restricting plate 3*a* with the step portion 14 and form the other side restricting plates 3*b* such that its sheet opposing face is flat, as shown in FIG. 7. In this case, a gap b (maximum B1-A) is half the gap a (maximum B-A) when the both side restricting plates 3*a*, 3*b* are provided with the step portions 14 (see FIG. 6). Thus, the deviation of the sheet in the width direction at the air blowing position can be suppressed. Accordingly, the accuracy of sheet position restriction can be improved.

By the way, the quantity of floating of the sheet changes depending on the weight, stiffness, suction condition and the like of a single sheet. The area of the step portion 14 needs to be specified considering these. On the other hand, the possibility that the sheet position may be deviated is increased by provision of the step portion 14. Thus, the area of the step portion 14 is separated to be as small as possible.

The step portions of the side restricting plates 3*a*, 3*b* do not need to be provided on the entire range of the side restricting plates 3*a*, 3*b* along the sheet feeding direction. That is, it is permissible to provide the step portion partially so as to reduce the friction resistance between the end portion of the sheet stack S and the side restricting plates 3*a*, 3*b* to such an extent that the sheet stack S can be floated. In this case, a highly accurate restriction is possible.

When the sheet is fed out, the topmost position of the sheet drops and when it is sensed by a sensor (not shown), the sheet tray 2 is raised so that the topmost position of the sheet is maintained at a predetermined position. In this while, the position of the sheet stack located below the step portion 14 is restricted by the side restricting plates 3*a*, 3*b* so that it is held at an accurate feeding criterion position. Then, the sheet can reach the air blowing position at its accurate position because the sheet stack is raised and moved to the air blowing position gradually.

Second Embodiment

The apparatus of the second embodiment will be described with reference to FIG. 8. Because the basic structure of the apparatus of this embodiment is the same as the first embodiment, duplicated description thereof is not explained and the structure characteristic of this embodiment will be described here. Further, like reference numerals are attached to components having the same function as the above-described embodiment.

In the sheet feeding device of this embodiment, of the side restricting plates 3*a*, 3*b*, the sheet opposing face of only one side restricting plate 3*a* is provided with the step portion 14 like the embodiment shown in FIG. 7 while the sheet opposing face of the other side restricting plate 3*b* is formed in a flat plane. According to this embodiment, a loosening fan 26 is disposed to blow air to the side end of the sheets in the sheet width direction perpendicular to the sheet feeding direction, in addition to the separation fan 6 (loosening nozzle 8 and separation nozzle 9) of the first embodiment. The loosening fan 26 is disposed on the side of the side restricting plate 3*a* provided with the step portion 14 so as to blow air to the side of the other side restricting plate 3*b* (in the direction of an arrow X) provided with no step portion from the side restricting plate 3*a*. The other structure and operation are the same as the first embodiment.

Accordingly, the sheets loosened by the loosening fan 26 and floating are moved in the direction to the side restricting plate 3*b* which is opposite to the air blowing direction, so that the gap between the sheet opposing face of the flat side restricting plate 3*b* and the sheet end portion disappears. Thus, by using this side restricting plate 3*b* as a sheet feeding criterion, the deviation of the sheet when it is fed can be reduced largely.

Figure 8:
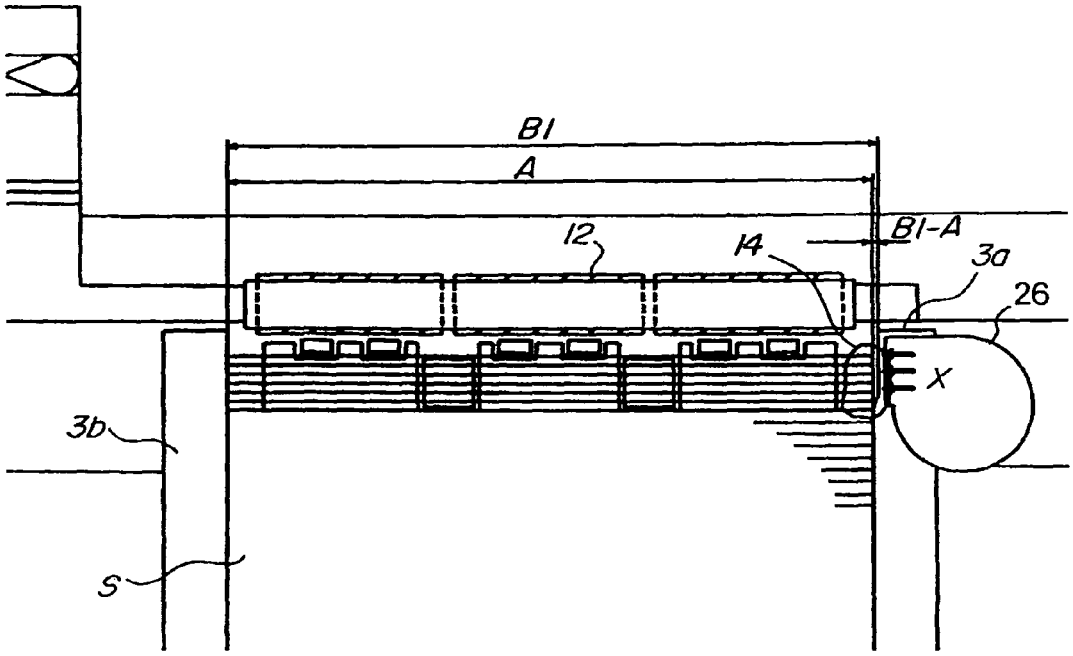
FIG. 8 is an explanatory diagram of the sheet feeding device according to a second embodiment.

On the other hand, the gap B1-A is formed corresponding to the step portion 14 as shown in FIG. 8. In this way, the interval B1 between the topside of the right and left side restricting plates 3*a*, 3*b* is set larger than the interval A on the lower side. Consequently, no friction resistance is generated between the sheet end portion and the side restricting plate 3*a*, so that an excellent floating state can be obtained.

Like the first embodiment, the step portion in the side restricting plate 3*a* does not need to be provided in the entire range of the side restricting plate 3*a* along the sheet feeding direction. That is, it is permissible to provide the step portion partially so as to reduce the friction resistance between the end portion of the sheet stack S and the side restricting plates 3*a*, 3*b* to such an extent that the sheet stack S can be floated. In this case, a highly accurate restriction is achieved.

Although the sheet feeding operation of this embodiment is substantially the same as the first embodiment, the effect of sheet loosening is intensified by blowing air from the side of the sheet stack with the loosening fan 26, whereby meeting diversified kinds of the sheets.

Because this embodiment can use the flat side restricting plate 3*b* as the criterion for sheet positioning, the positioning criterion position is not deviated even if there occurs a gap between the sheet end portion and the side restricting plate 3*a* at the air blowing position. Thus, the deviation of the sheet positioning can be suppressed to a minimum value while maintaining an excellent floating state.

Third Embodiment

Next, the apparatus according to the third embodiment will be described with reference to FIG. 9. Because the basic structure of this embodiment is the same as the first and second embodiments, duplicated description thereof is not explained and the structure characteristic of this embodiment will be described. Same reference numerals are attached to components having the same function as the above-described embodiments.

In this embodiment also, the sheet opposing face of only one side restricting plate 3*a* is provided with the step portion 14 while the sheet opposing face of the other side restricting plate 3*b* (not shown in FIG. 9) is formed in a flat plane like the second embodiment. According to this embodiment, the loosening fan 26 is disposed to blow air in the sheet width direction perpendicular to the sheet feeding direction.

According to this embodiment, an auxiliary restricting plate 15 as a restricting member is provided at the step portion 14 of the side restricting plate 3*a* such that it can be rotated between positions indicated with a solid line and a two dot and dash line by driving means such as a solenoid (not shown) around a shaft 16. This auxiliary restricting plate 15 is located at the position indicated by the solid line in FIG. 9 when the sheets on the sheet tray 2 is located at the replenishment position. The interval between the sheet opposing face of the auxiliary restricting plate 15 and the sheet opposing face of the side restricting plate 3*b* opposing this at this time is A which is equal to the interval between the sheet opposing faces of the side restricting plates 3*a*, 3*b* at the replenishment position.

Thus, when sheets are replenished to the sheet tray 2 (not shown in FIG. 9), the interval A is secured up to the topmost of the side restricting plates 3*a*, 3*b* and thus, the sheets can be set without any deviation of their position.

Figure 9:
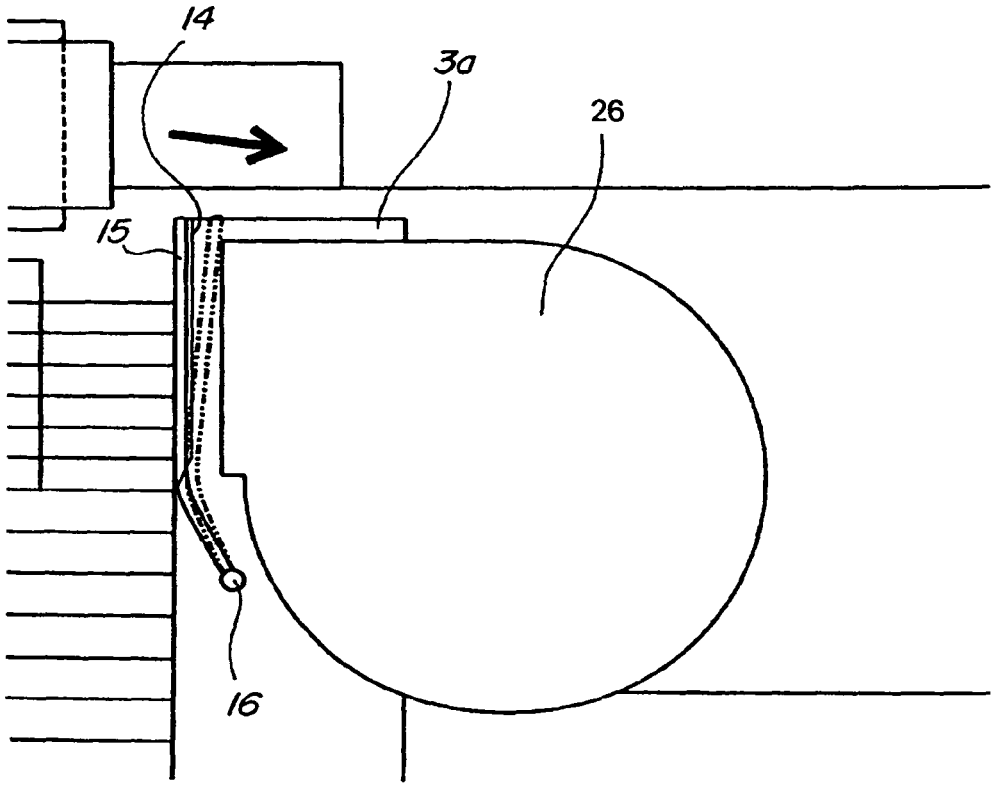
FIG. 9 is an explanatory diagram of the sheet feeding device according to a third embodiment.

Next, when the sheet tray 2 rises so that the topmost portion of the loaded sheet stack S reaches the air blowing position, driving means (not shown) is actuated and the aforementioned auxiliary restricting plate 15 is rotated to the position indicated by the two dot and dash line of FIG. 9. At this time, the auxiliary restricting plate 15 retreats in a direction off the side restricting plate 3*b* from the step portion 14. Accordingly, the interval between the side restricting plates 3*a* and 3*b* at the air blowing position is increased by an amount corresponding to the existence of the step portion 14 so that it turns to B1 like the second embodiment. Thus, the gap B1-A is generated between the sheet end portion and the side restricting plate 3*a* at the air blowing position. As a result, the same effect as described in the second embodiment can be obtained. The topside of the sheet stack S is also restricted by the side restricting plates 3*a*, 3*b* when the topside of the sheet stack S is moved to the air blowing position thereby preventing the topside of the sheet stack S from being shifted by a vibration or the like when the sheet stack is raised. Then, the sheets can be loosened excellently because the sheet stack is arranged neatly when air is blown to the sheet stack.

In the meantime, the driving means for swinging the auxiliary restricting plate 15 does not need to be provided independently but it may be constructed to be interlocked with the rising operation of the sheet tray 2.

Other Embodiment

The side restricting plates 3*a*, 3*b* of each of the above-described embodiments can be moved symmetrically and are used for positioning of the sheet width direction with its central position as a criterion. However, the sheet may be positioned with its one side as a criterion by fixing one side restricting plate 3*b* while the other side restricting plate 3*a* can be slid in the sheet width direction.

At this time, in the structure in which one side restricting plate 3*b* is formed in a flat plane while the other side restricting plate 3*a* is provided with the step portion 14 in each of the above-described embodiments, the flat side restricting plate 3*b* is fixed. As a consequence, the flat plane of the side restricting plate 3*b* serves as a criterion position for positioning the sheet thereby facilitating the positioning of the sheet to be fed.

Although according to this embodiment, the side restricting plate is provided with the step portion, the side restricting plate may be provided with a tapered face which widens outward as it goes upward.

Figure 10:
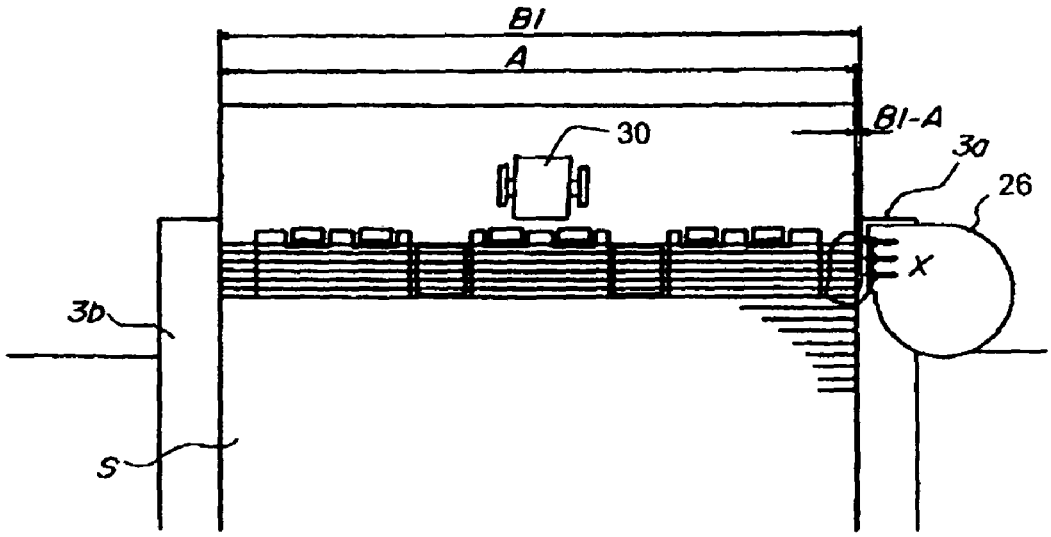
FIG. 10 is a front view of the separation method according to other embodiment.
Figure 11:
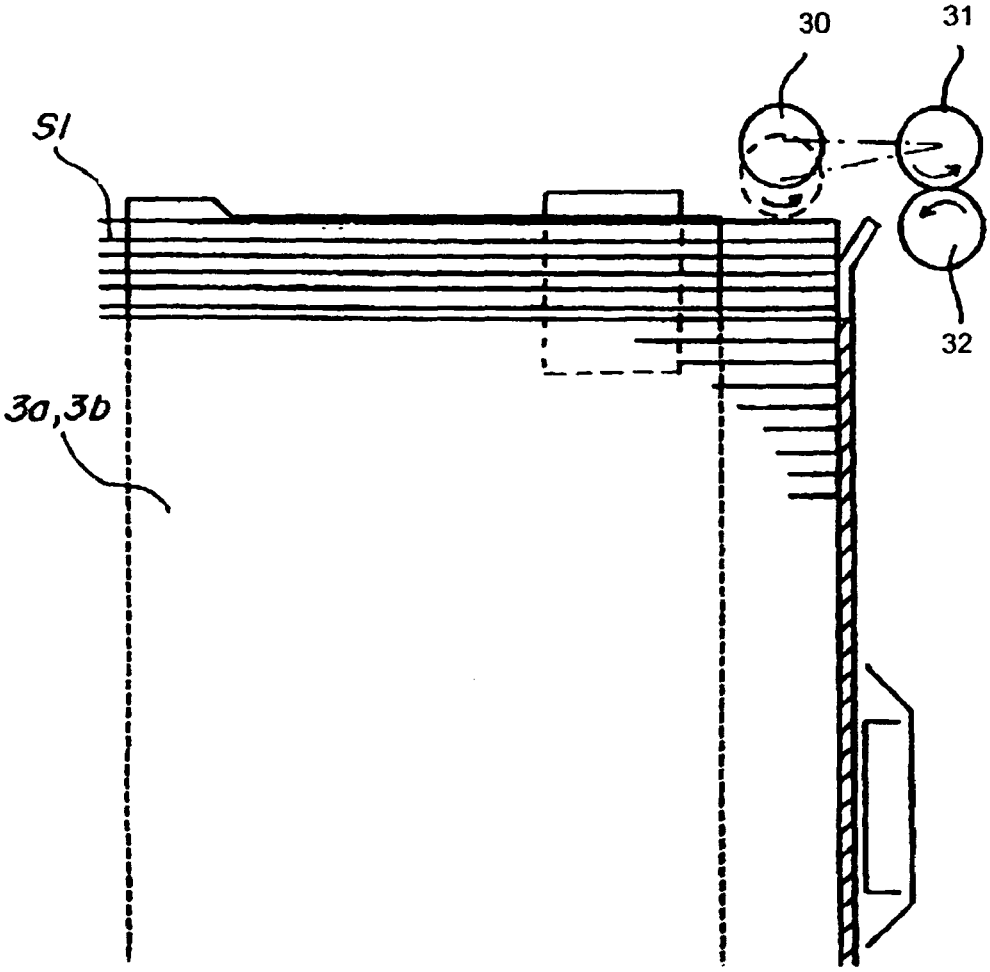
FIG. 11 is a side view of the separation method shown in FIG. 10.
Figure 12:
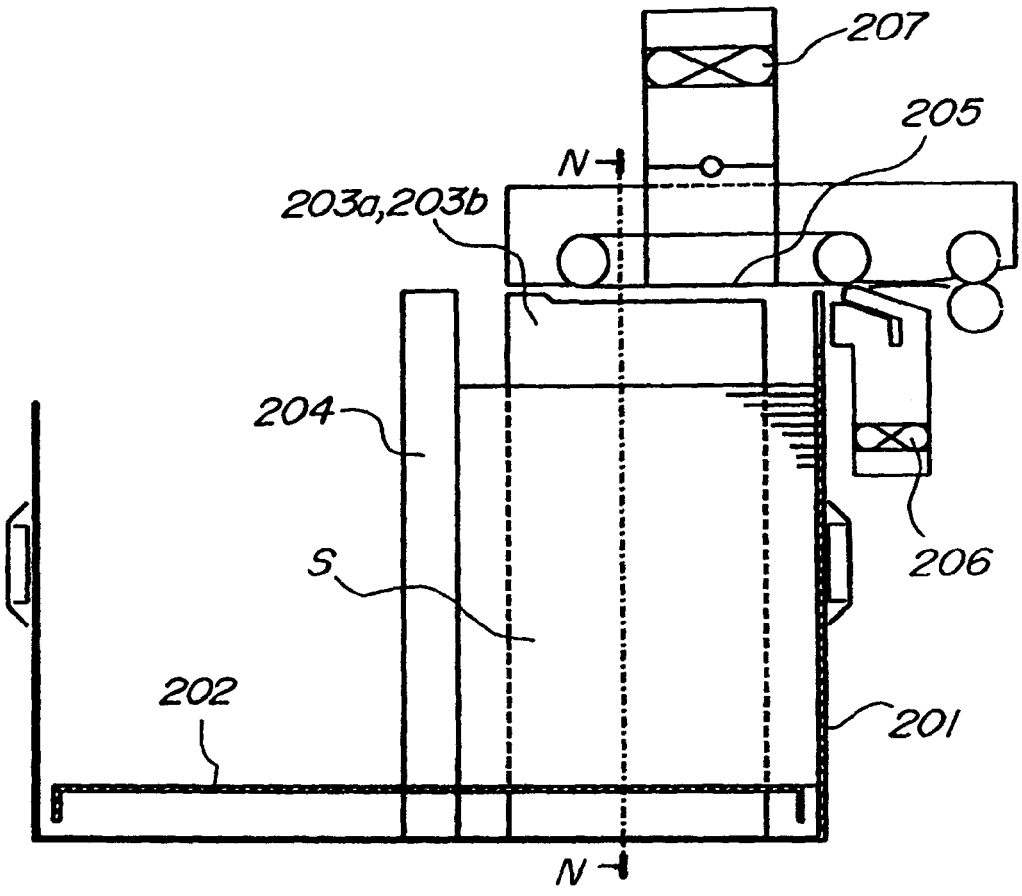
FIG. 12 is a sectional schematic explanatory diagram of a conventional air sheet feeding device.
Figure 13:
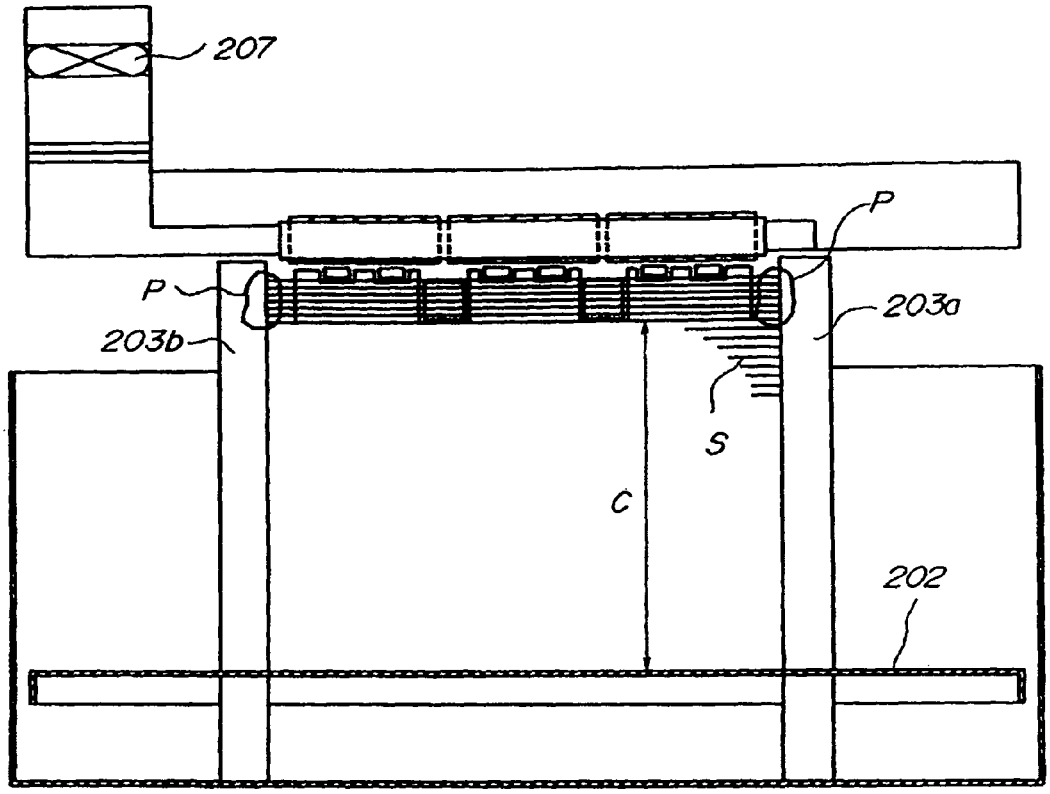
FIG. 13 is a sectional view taken along N-N in FIG. 12.

Although this embodiment adopts the structure of feeding the sheet with the suction conveyance belt, the present invention is not restricted to this example, but the present invention may be applied to the sheet feeding device of so-called retard roller separation type using a reversing roller as shown in FIGS. 10, 11. According to this system, the stacked sheet S is fed with a pickup roller 30 and each sheet is separated between a feed roller 31 rotating normally and a retard roller 32 rotating reversely. This separation system does not need the separation fan 6 but uses only the loosening fan 26 for blowing air to the side face of the sheets.

Further, although the above-described embodiments refer to the image forming apparatus using the sheet feeding device 101, the sheet feeding device of the present invention may be used in an image reading apparatus to which each original is separated and fed to its image reading device by that sheet feeding device.

This application claims the benefit of priority from the prior Japanese Patent Application No. 2005-188802 filed on Jun. 28, 2005 the entire contents of which are incorporated by reference herein.

What is claimed is:

1. A sheet feeding device which loosens sheets for feeding by blowing air to the end portions of the sheets, comprising:

a sheet tray provided such that it is capable of lifting up/down with the sheets supported;

an air blowing portion which loosens the sheets by blowing air to an upper end portion of the sheets supported by the sheet tray; and a pair of restricting members which restricts both end portions of the sheets supported by the sheet tray in a direction perpendicular to a sheet feeding direction at the sheet opposing faces opposing the end portions of the sheets, wherein an upper portion of one of the pair of restricting members has a step portion consisting of a folded portion and a vertical surface above the folded portion, and an upper portion of an other of the pair of restricting members is formed flat as a sheet feeding criterion of the sheet, so that the distance between the sheet opposing ends at the upper portion of the pair of the restricting members adjacent the upper vertical surface is set larger than the distance between the sheet opposing faces below the position in which air is blown to the sheets with the air blowing portion, and wherein the air blowing portion is disposed on the side of the one of the pair of restricting members which has a step portion so as to blow air toward the other of the pair of restricting members.

2. The sheet feeding device according to claim 1, wherein at least one of the pair of restricting members is movably supported, the sheet tray is provided to be movable between a replenishment position for replenishing the sheets and an air blowing position for loosening the sheets by blowing air to the top portion of the sheet stack supported to feed each sheet and after the sheet tray is moved from the replenishment position to the air blowing position, the movable restricting member is moved so that the distance between the sheet opposing faces of the topside of the restricting member is expanded.

3. The sheet feeding device according to claim 2, wherein the restricting member located on one side of the sheet supported by the sheet tray is fixed while the restricting member located on the other side of the sheet is movable and the air blowing portion is disposed on the side of the movable restricting member and along the direction perpendicular to the sheet feeding direction.

4. An image forming apparatus including a sheet feeding device which loosens sheets for feeding by blowing air to the end portion of the sheets and an image formation device which forms an image on the sheet fed from the sheet feeding device, wherein the sheet feeding device comprises:

a sheet tray provided to be capable of lifting up/down supporting the sheets;

an air blowing portion which loosens the sheets by blowing air to an upper end portion of the sheets supported by the sheet tray; and a pair of restricting members which restrict both end portions in the direction perpendicular to the sheet feeding direction of the sheet supported by the sheet tray, wherein an upper portion of one of the pair of restricting members has a step portion consisting of a folded portion and a vertical surface above the folded portion, and an upper portion of an other of the pair of restricting members is formed flat as a sheet feeding criterion of the sheet, so that the distance between the sheet opposing faces at the upper portion of the pair of restricting members adjacent the upper vertical surface is set larger than the distance between the restricting members below the position in which air is blown to the sheets with the air blowing portion, and wherein the air blowing portion is disposed on the side of the one of the pair of restricting members which has the step portion so as to blow air toward the other of the pair of restricting members.

5. The image forming apparatus according to claim 4, wherein at least one of the pair of restricting members is supported movably, the sheet tray is provided to be movable between a replenishment position for replenishing the sheets and an air blowing position for loosening the sheets by blowing air to the top portion of the sheet stack supported to feed each sheet and after the sheet tray is moved from the replenishment position to the air blowing position, the movable restricting member is moved so that the distance between the sheet opposing faces of the topside of the restricting member is expanded.

6. The image forming apparatus according to claim 5, wherein the restricting member located on one side of the sheet supported by the sheet tray is fixed while the restricting member located on the other side of the sheet is movable and the air blowing portion is disposed on the side of the movable restricting member and along the direction perpendicular to the sheet feeding direction.

* * * * *